US008961069B2

(12) United States Patent
Long

(10) Patent No.: US 8,961,069 B2
(45) Date of Patent: Feb. 24, 2015

(54) SUBSEA HANGING DEVICE

(76) Inventor: Nicholas Long, Swansea (GB)

( * ) Notice: Subject to any disclaimer, the term of this patent is extended or adjusted under 35 U.S.C. 154(b) by 367 days.

(21) Appl. No.: 13/309,516

(22) Filed: Dec. 1, 2011

(65) Prior Publication Data

US 2012/0141212 A1 Jun. 7, 2012

(30) Foreign Application Priority Data

Dec. 1, 2010 (GB) ..... 1020337.0

(51) Int. Cl.
*F16L 1/12* (2006.01)
*E21B 41/00* (2006.01)
*E21B 41/10* (2006.01)

(52) U.S. Cl.
CPC ..... *E21B 41/0014* (2013.01); *E21B 41/10* (2013.01)
USPC ..... 405/170; 405/169; 405/158; 166/338; 166/341

(58) Field of Classification Search
USPC ..... 405/158, 184.4, 169, 170, 172, 174, 405/190; 294/81.3, 67.21, 67.5; 166/338, 166/341, 344, 347, 360
See application file for complete search history.

(56) References Cited

U.S. PATENT DOCUMENTS 3,146,016 A * 8/1964 Daymon, Jr. ..... 294/81.3
3,258,138 A * 6/1966 Keen ..... 414/207
4,597,602 A * 7/1986 McGriff ..... 294/81.3

FOREIGN PATENT DOCUMENTS

JP 02033086 * 2/1990

* cited by examiner

*Primary Examiner* — Sean Andrish

(57) ABSTRACT

A subsea hanging device comprises a hanging frame 1 adapted to support an assembly (such as a gooseneck 3 and a subsea connector 4 being used to attach a heavy pipe 7 to a pipe hub 11 on the seabed), a hanging eye 8 which slides on said frame when a shaft 10 threaded through it is axially rotated, and a ROV drive bucket 12 attached to one end of the shaft. A guide funnel 13, 16 pivoted to the frame and adapted to fit over a guide post 17 on the seabed actuates a pointer 15 which indicates on a scale 14 whether the hanging angle needs adjustment to enable the connector 4 to be engaged with the hub 11.

9 Claims, 2 Drawing Sheets

SUBSEA HANGING DEVICE

BACKGROUND OF THE INVENTION

Figure 1A:
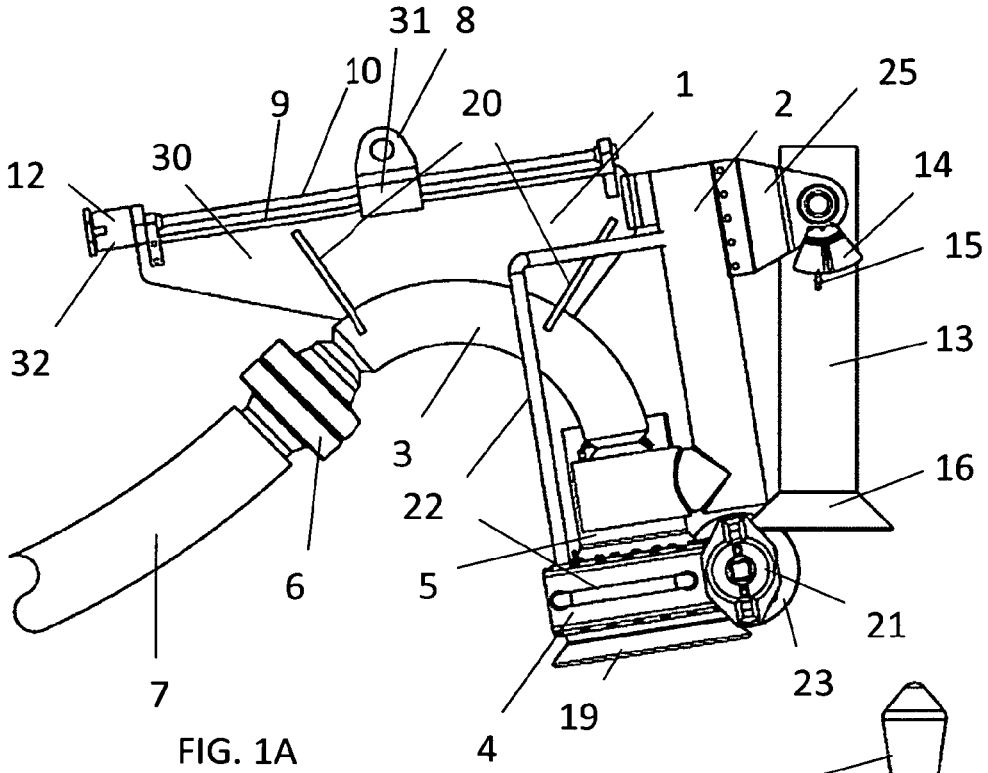

In the subsea gas and oil extraction industry it is usually necessary, when manoeuvring an object or assembly into place at a subsea location, for a subsea remotely operated vehicle ROV to assist in the orientation and positioning of the object or assembly. This does not pose any great difficulty when the assembly is hanging freely (e.g. from a crane or other lifting machine on a surface vessel or platform). Its weight would be supported by the lifting machine and its hanging point or points can be preset so that its orientation is more or less correct. The provision of one or more ROV grab handles on the assembly would normally be sufficient for the ROV to be able to carry out its tasks. When however the assembly is already connected to or forms part of other equipment, its orientation can change as it is moved due to changing forces exerted by the equipment. If the assembly is a subsea connector, a hub and a gooseneck attached by a flexible pipe being installed at a subsea location and possibly already connected to subsea equipment, any force exerted by the pipe on the assembly may cause the connector to be in incorrect orientation for engagement with and connection to a second hub already installed at the subsea location.

BRIEF SUMMARY OF THE INVENTION

The object of the present invention is to provide a subsea flexible pipe installation device, the position of a hanging arrangement of said device and thus an angle at which said device hangs when connected to said flexible pipe which exerts a force thereon can be adjusted by a remotely operated vehicle.

BRIEF SUMMARY OF THE INVENTION

The present invention provides a subsea flexible pipe installation device comprising a hanging frame adapted to be attached to an object or assembly (subsequently referred to as an assembly), a hanging arrangement slidably mounted on said frame, a threaded shaft rotatably mounted on said frame and passing through a threaded bore in said hanging arrangement so that rotation of said shaft about its axis causes said hanging point to move along said frame, and an arrangement actuable by a remotely operated vehicle (subsequently referred to as a ROV) to cause said shaft to rotate.

Preferably said arrangement actuable by a remotely operated vehicle includes a ROV drive bucket attached to one end of said shaft.

Preferably an alignment gauge giving a visual indication of a hanging angle of said frame relative to vertical is provided.

More preferably said alignment gauge includes a guide member mounted to hang freely in at least a range of angles in a vertical plane which includes the axis of said shaft.

Even more preferably a scale on or attached to said frame or said guide member moves relative to a pointer on or attached to said guide member or said frame to give said visual indication.

The guide member may also serve as a guide funnel adapted to fit over a guide post (when said hanging device is correctly positioned) at the desired location.

DETAILED DESCRIPTION OF THE INVENTION

Figure 1B:
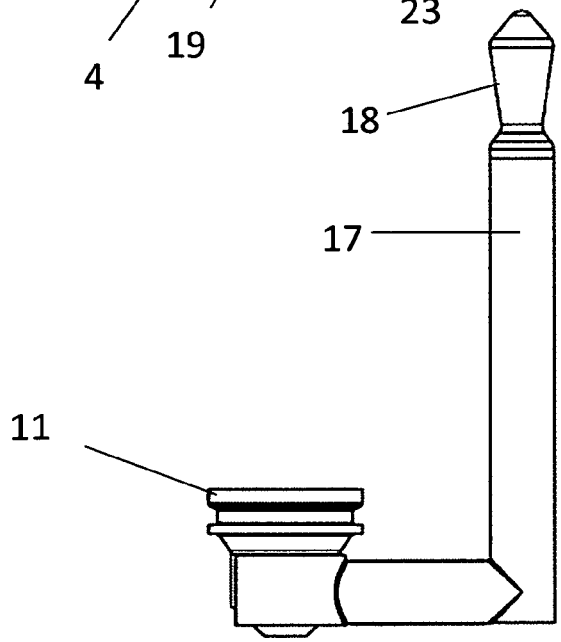

The invention will now be described solely by way of example and with reference to the accompanying drawings in which:

FIG. 1A shows a side view including a hanging device and exemplary assembly near a subsea location but incorrectly orientated, and FIG. 1B shows equipment installed at a subsea location.

Figure 2:
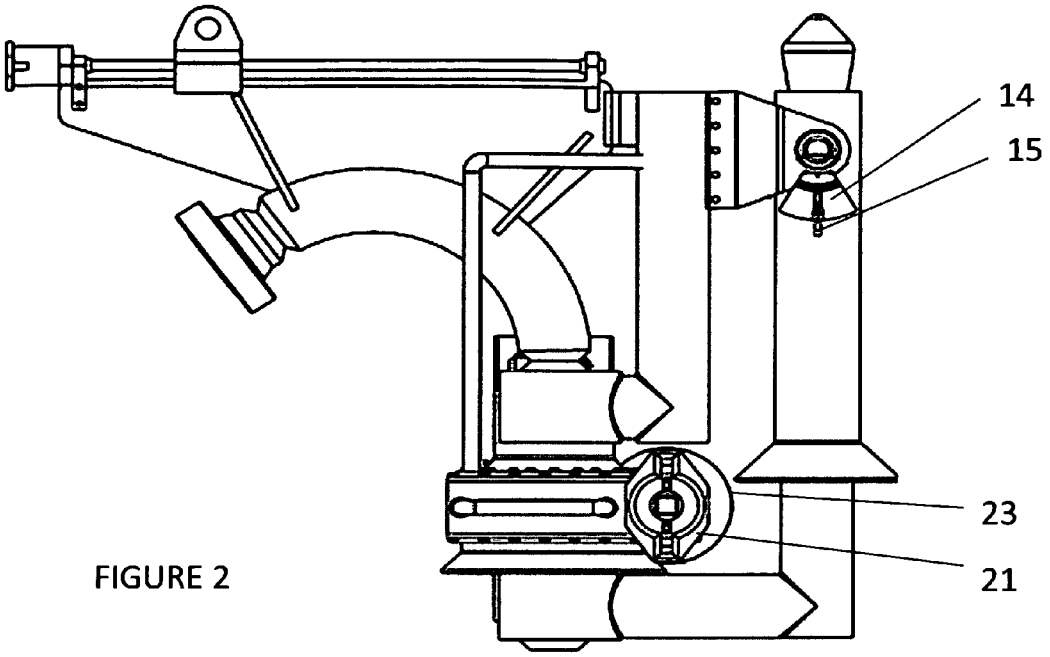
Figure 3:
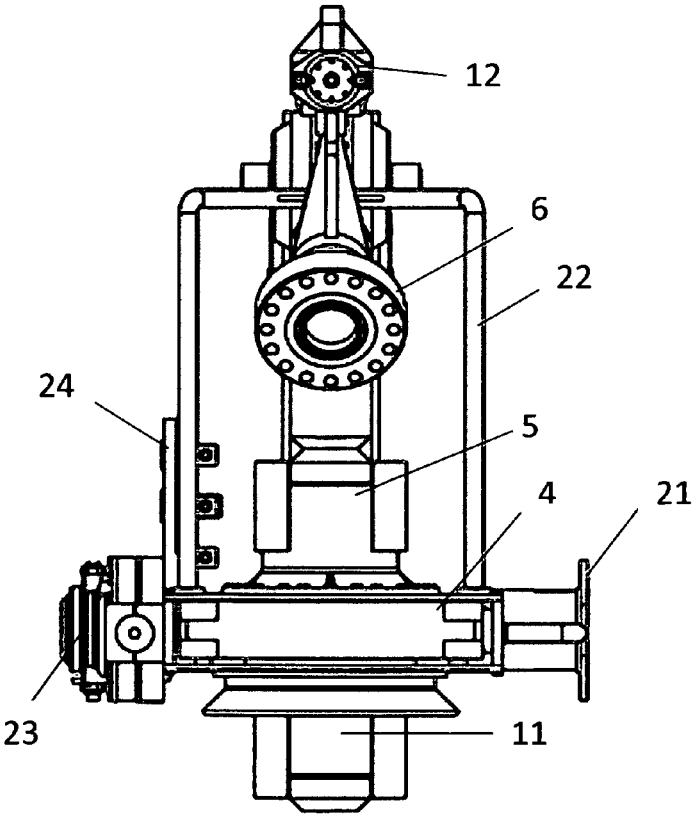

FIG. 2 a side view including a hanging device and exemplary assembly correctly orientated and positioned at the desired location, and FIG. 3 shows an end view.

DETAILED DESCRIPTION OF THE INVENTION

As shown a subsea hanging device comprises a hanging frame including plates 1 and 20 and a tube 2 to which are attached an exemplary assembly, comprising a gooseneck 3 (which is attached to the plate 1 with the aid of sub-plates 20), and a subsea connector 4 (connected to one end of the gooseneck via a first hub 5 which is attached to the tube 2). A heavy flexible (e.g. steel) pipe 7 is connected at one of its ends to the gooseneck via a flange 6. The pipe is being installed or is already connected at the other of its ends to subsea equipment. A hanging arrangement, which may be a hanging eye 8, is slidably mounted on the hanging frame.

In use the hanging eye would be attached to a crane or other lifting machine on a surface vessel or platform. The lifting machine supports the weight of the frame as the frame is manoeuvred for example close to the sea bed. The frame hangs from its lifting eye at an angle dependent on any pull or other force exerted via the flexible pipe 7 on the flange 6. The angle varies as the assembly is manoeuvred towards its desired position. This may cause the subsea connector 4 to be in incorrect orientation for engagement with and connection to a second hub 11 already installed at a subsea location and connected to further subsea equipment not shown.

To enable this angle to be adjusted by a ROV controlled by an operator, the hanging eye is slidably mounted on said frame and preferably fits over and around a rail portion 9 of the plate 1. A threaded shaft 10 is rotatably mounted on said frame (e.g. by being journelled near both ends to the plate 1) so that it is free to rotate about its axis, and passes through a threaded bore in the hanging eye so that rotation of said shaft about its axis causes said hanging eye to move along said frame. An arrangement actuable by a ROV to cause said shaft to rotate is also provided. Preferably this is a ROV drive bucket 12 attached to one end of said shaft. Alternatively or more preferably in addition a hydraulic or electrical motor controlled by a ROV actuable control panel may be used to rotate the shaft. The motor could be connected directly to the other end of the shaft.

Since the pipe would normally pull in only one direction and the frame is otherwise free to rotate about a vertical axis, the assembly can be attached to the frame so that the force exerted by the pipe on the frame is in a vertical plane which includes the axis of said shaft 10. Thus only the angle of orientation of the frame in this vertical plane would normally need to be adjusted.

An alignment gauge giving to a ROV operator a visual indication of a hanging angle of the frame relative to vertical in this plane is preferably provided. As shown a guide member 13 is pivotally attached to the frame via a hinge bracket 25 so as to hang freely in at least a range of angles in this vertical plane. The range may be limited by engagement of the guide member 13 with the tube 2 and/or by the provision of at least one stop on the hinge bracket and/or guide member. While the guide member hangs freely, any change in the hanging angle causes a scale 14 on or attached to the bracket or frame to move relative to a pointer 15 on or attached to said guide member to give the visual indication.

The guide member may also serve as a guide funnel adapted to fit over a guide post when said hanging device is correctly positioned at the desired location. As shown the guide member is in the form of a tube funneled at its lower end 16. It fits over a guide post 17, which may have a specially shaped upper end 18, and is attached to the hub 11.

When in use the funneled end 16 is close to the shaped end 18 a ROV may if desired engage with the drive bucket 12 and rotate the shaft 10 moving the hanging eye 8 so as to change the hanging angle of the frame. This may move the pivot point from the guide member hangs and/or the angular disposition of the guide member if it has reached a limit, and facilitate locating its funneled end 16 over the shaped end 18 of the guide post 17.

To enable the subsea connector 4 to engage with the hub 11 as the guide member 13 is lowered towards its lowest position on the guide post the hanging angle must be correct within limits of say a few degrees. The alignment gauge can be inspected via a ROV to check that the correct hanging angle has been obtained as indicated by GO/NO GO markings on the alignment gauge. If necessary the position of the hanging eye 8 can be adjusted or further adjusted until the angle is correct within those limits. The subsea connector 4 may include a guide funnel 19 which engages the hub 11 continuing the alignment process which may be completed when the subsea connector is actuated to interconnect the hubs 5 and 11 and form a seal therebetween.

The subsea connector may be as or similar to that disclosed in United Kingdom Patent Application GB0922132.6 (Leadscrew and Sub-Sea Connector). As best shown in FIG. 3 of the present application the subsea connector may be actuable by a ROV drive bucket 21. It may also or alternatively include a hydraulic or electric motor 23 controlled via a ROV control panel 24. ROV grab handles 22 may be provided.

The invention claimed is:

1. A subsea flexible pipe installation device comprising a hanging frame adapted to be attached to an object or assembly including a subsea connector, a hub and a gooseneck, a hanging arrangement slidably mounted on said frame, a threaded shaft rotatably mounted on said frame and passing through a threaded bore in said hanging arrangement so that rotation of said shaft causes said hanging arrangement to move along said frame, and an arrangement actuable by a remotely operated vehicle ROV to cause said shaft to rotate.

2. The subsea hanging device as claimed in claim 1, in which said arrangement actuable by a remotely operated vehicle includes a ROV drive bucket attached to one end of said shaft.

3. The subsea hanging device as claimed in claim 1, including an alignment gauge giving a visual indication of a hanging angle of said frame relative to vertical.

4. The subsea hanging device as claimed in claim 3, in which said alignment gauge includes a guide member mounted to hang freely in at least a range of angles in a vertical plane which includes the axis of said shaft.

5. The subsea hanging device as claimed in claim 4, in which a scale on or attached to said frame or said guide member moves relative to a pointer on or attached to said guide member or said frame to give said visual indication.

6. The subsea hanging device as claimed in claim 4, in which the guide member also serves as a guide funnel adapted to fit over a guide post at the desired location.

7. The subsea hanging device as claimed in claim 2, in which said hanging arrangement includes a hanging eye and is slidably mounted on said frame.

8. The subsea hanging device as claimed in claim 1, in which said arrangement actuable by a remotely operated vehicle includes a hydraulic or electric motor controlled by a ROV actuable control panel.

9. The subsea hanging device as claimed in claim 2, in which said arrangement actuable by a remotely operated vehicle also includes a hydraulic or electric motor controlled by a ROV actuable control panel.

* * * * *